United States Patent [19]

Carmichael

[11] Patent Number: 4,691,604

[45] Date of Patent: Sep. 8, 1987

[54] ANTI-JAMMING DIE

[75] Inventor: Kenneth Carmichael, Marion, Ind.

[73] Assignee: Peerless Machine & Tool Corporation, Marion, Ind.

[21] Appl. No.: 855,739

[22] Filed: Apr. 25, 1986

[51] Int. Cl.[4] ..... B26D 7/06

[52] U.S. Cl. ..... 83/164; 83/165; 83/97; 83/104; 83/105

[58] Field of Search ..... 83/164, 165, 162, 163, 83/166, 97, 94, 104, 105, 687, 691

[56] References Cited

U.S. PATENT DOCUMENTS

| | | | |
|---|---|---|---|
| 505,095 | 9/1893 | Colgrove | 83/165 |
| 1,865,947 | 7/1932 | Novick | 83/97 |
| 2,618,311 | 11/1952 | Parker | 83/97 X |
| 3,878,745 | 4/1975 | Handziak et al. | 83/165 X |

*Primary Examiner*—E. R. Kazenske
*Assistant Examiner*—Scott A. Smith
*Attorney, Agent, or Firm*—Barnes & Thornburg

[57] ABSTRACT

An improved press produces oval blanks arranged in a "nested" pattern from a web of material. The press includes a cutting die plate having a plurality of oval-shaped discharge apertures, an inclined die shoe underneath the cutting die plate, and a punch for piercing a web supported on the cutting die plate to form blanks and then deposit the blanks into the inclined die shoe via the discharge apertures. Partitions divide the inclined die shoe into a plurality of blank transfer lanes. Each transfer lane connects one of the discharge apertures to a companion exit region. Guide rails are provided to guide blanks deposited into the transfer lanes toward the exit regions as the blanks fall under gravity through the inclined die shoe. A ramp is provided in selected transfer lanes to tilt the falling blanks therein relative to the path established by the guide rails to move those blanks laterally in the selected transfer lanes away from an adjacent transfer lane to avoid entanglement problems which could jam the die.

22 Claims, 5 Drawing Figures

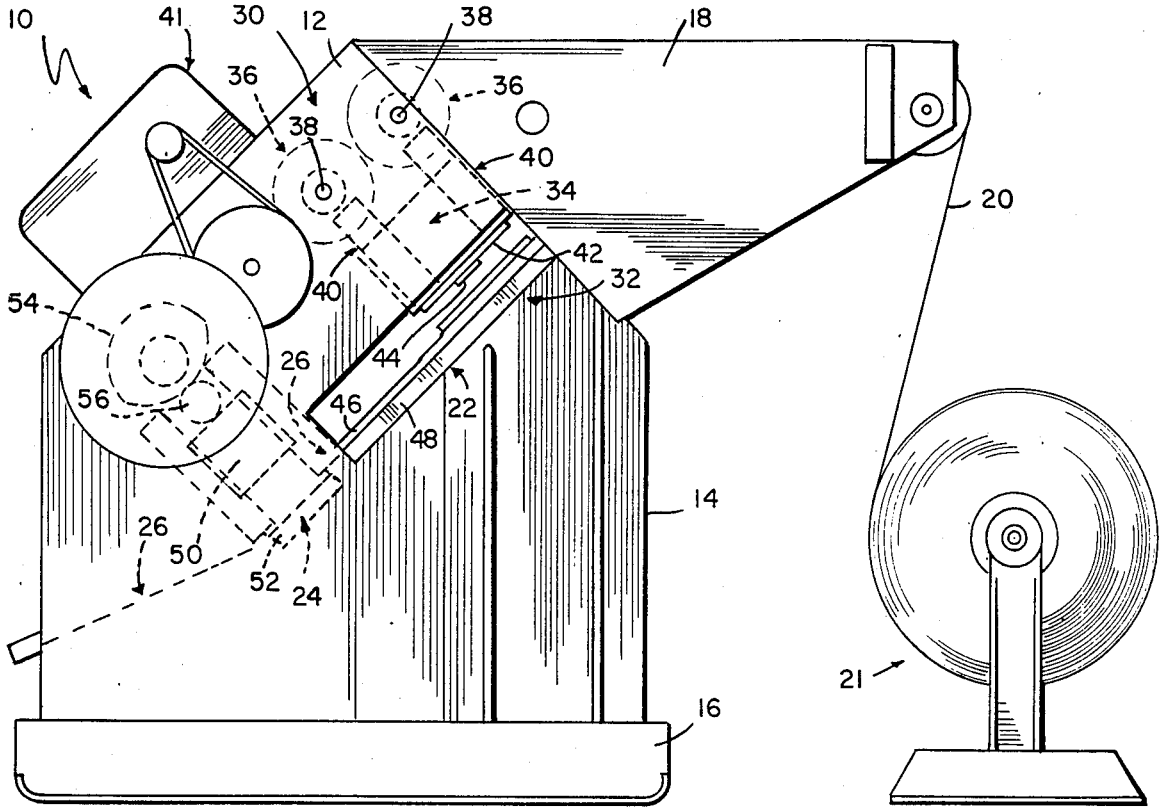
FIG. 1
FIG. 2
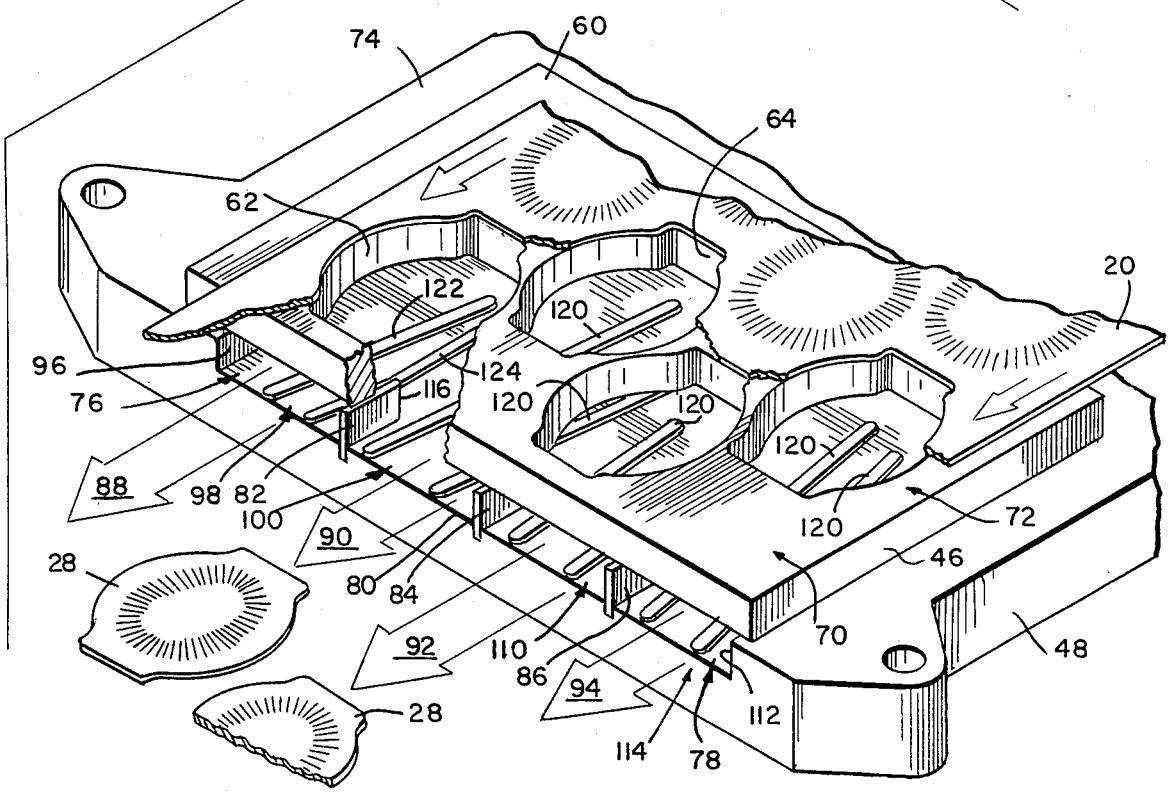

ANTI-JAMMING DIE

BACKGROUND AND SUMMARY OF THE INVENTION

This invention relates to a press die system for producing blanks from a sheet of material, and particularly to a guide system for releasing a plurality of blanks arranged in nested relation from a gravity feed die to aid in preventing jamming of the die.

In recent years, the popularity of oval-shaped paper plates and trays has increased. Consumer plate and tray shape preferences have changed and manufacturers have responded by attempting to provide suitable alternatives to the standard round and rectangular shapes. It will be appreciated that other oblong shapes having straight and curved edges are also becoming more popular with consumers.

One problem with the manufacture of an oval plate or tray shape as compared to rounds or rectangulars is that sheet material is generally wasted during conventional blanking operations. It will be appreciated that "trim" waste can be reduced by setting up a press to "nest" the oval blanks together in closely packed relation to one another on the sheet material to be blanked. However, a significant amount of sheet material is wasted by forming oval-shaped plate or tray blanks in a standard, regimented, columnar array using conventional web-feed presses that are unable to "nest" the oval blanks. Known presses are unable to release nested blanks without causing one or more of the blanks to jam the machine during ejection.

One object of the present invention is to provide reliable means for releasing blanks from a die configured to run the blanks close together, e.g., in "nested" relation.

Another object of the present invention is to provide means for guiding adjacent blanks falling under gravity through a die away from each other and away from certain portions of the die to reduce the likelihood that the die will be jammed due to entanglement of the blanks with each other and with the die itself.

According to the present invention, a press die system is provided for producing blanks from a sheet or web of material. The press die system includes an inclined die shoe having a blank delivery region, partition means for dividing the blank delivery region into a plurality of individual exit regions, and blanking means for piercing the sheet or web of material in a predetermined pattern. The press die system further includes guide means for guiding each of the blanks generated by the blanking means along a separate blank transfer path toward a companion exit region. The guide means is configured to define a blank transfer plane extending across the blank delivery region. Ramp means is provided for tilting blanks guided along at least one of the blank transfer paths relative to the blank transfer plane to reduce the number of jamming incidents that would otherwise occur along said at least one of the blank transfer paths.

In use, the blanking means generates a plurality of blanks that are deposited into the inclined die shoe and arranged to fall under gravity onto the guide means for movement toward the individual exit regions. The ramp means acts to move blanks guided along a particular blank transfer path laterally in relation to an adjacent blank transfer path by tilting the blanks. Lateral blank movement as a result of tilting aids in preventing entanglement of blanks falling through the press die system with other blanks and with portions of the press die system itself.

In preferred embodiments of the present invention, the press die system further includes a cutting die plate having a surface for supporting the sheet or web of material and a plurality of blank discharge apertures shaped to discharge oval plate or tray blanks and arranged in a "nested" pattern. The partition means forms a plurality of blank transfer lanes in the die shoe that are situated underneath the cutting die plate to provide outer boundaries for the blank transfer paths. Blanks are conducted out of the die under gravity along these blank transfer lanes. Each blank transfer lane extends from an entrance region positioned in alignment with only one of the overlying blank discharge apertures to its individual exit region.

Inclination of the die shoe causes blanks deposited into each blank transfer lane by the blanking means to fall under gravity along a transfer path toward the exit region. The partition means includes a partition member situated intermediate each pair of adjacent blank transfer lanes to aid in preventing movement of a blank from one blank transfer lane to an adjacent blank transfer lane during gravity discharge of the blanks from the die.

Pairs of first guide rails are situated in substantially coplanar spaced-apart relation in most of the blank transfer lanes to form the guide means. However, at least one of the blank transfer lanes is a specially configured "anti-jamming lane". Such a lane is generally situated in or near an outermost portion in the die shoe along a longitudinal boundary edge of the blank delivery region. Instead of the companion pair of first guide rails, the anti-jamming lane includes a first guide rail aligned in substantially coplanar relation with the pairs of first guide rails provided in other lanes and a second guide rail configured to provide the ramp means.

The second guide rail desirably includes a downstream portion that is positioned in proximity to the exit region of the designated anti-jamming lane and aligned in substantially coplanar relation to its companion first guide rail. The second guide rail further includes an upstream portion made of a resilient material that extends into the entrance region of the anti-jamming lane and is canted at a compound angle in relation to the companion first guide rail. Thus, the canted second portion is inclined to slope downwardly within the anti-jamming lane in a direction away from the immediately adjacent blank transfer lane toward the exit region of the anti-jamming lane and away from the partition member situated between the anti-jamming lane and the immediately adjacent blank transfer lanes.

The features of the present invention advantageously make feasible gravity discharge of blanks from a die shoe assembly set up to cut "nested" blanks from a web of sheet material by providing a reliable means of releasing the blanks from the die shoe assembly without entangling the blanks and thereby jamming the die. The novel release feature is generally positioned in outermost blank transfer lanes experiencing frequent jamming problems. This release feature causes the blanks in such designated "anti-jamming" lanes to move laterally in the die away from potential entanglement locations before falling out of the die through the exit region.

Lateral movement of the type described above is particularly desirable in nested blanking operations of the type forming forward and rearward lines or series of blanks extending across the width of the die shoe in which blanks in the forward series alternate in staggered, nested relation with blanks in the rearward series. This nested blanking pattern is desirably used in forming in substantially oval-shaped blanks to reduce trim waste of the blanking material in a most advantageous manner. Identification of frequently jammed blank transfer lanes best suited for inclusion of the release feature and the most advantageous location of the release feature will be explained in greater detail in the detailed description of the drawings set forth below.

One feature of the present invention is the provision of ramp means in a designated anti-jamming lane for guiding blanks moving under gravity through a selected blank transfer lane in a lateral direction away from an adjacent blank transfer lane. This feature advantageously releases blanks from the die in a reliable manner by moving "neighboring" blanks traveling along adjacent paths apart from one another. This separating movement reduces the risk of jamming the die due to entanglement of the neighboring blanks with each other about the partition members situated between the adjacent paths.

Another feature of the present invention is the provision of a canted guide rail in the designated anti-jamming lane. This canted guide rail extends into the entrance region of the anti-jamming lane to lie within a "blank discharge zone" extending between the support surface of the cutting die plate and the die shoe. The canted guide rail is made of a resilient material to intercept blanks falling under gravity through the blank discharge zone from the overlying blank discharge aperture, and yieldably urge those blanks toward the individual exit region of the designated anti-jamming lane in the above-described lateral anti-jamming direction.

Additional objects, features, and advantages of the invention will become apparent to those skilled in the art upon consideration of the following detailed description of a preferred embodiment exemplifying the best mode of carrying out the invention as presently perceived.

BRIEF DESCRIPTION OF THE DRAWINGS

The detailed description particularly refers to the accompanying figures in which:

FIG. 1 is a side elevation view of a web-feed blanking and forming die embodying the present invention with portions broken away to reveal a die assembly including a cutting die plate and an inclined die shoe;

FIG. 2 is an enlarged perspective view of the die assembly of FIG. 1 with portions broken away to reveal nested blank discharge apertures in the cutting die plate and the blank transfer lanes in the underlying die shoe;

DETAILED DESCRIPTION OF THE DRAWINGS

Figure 3:
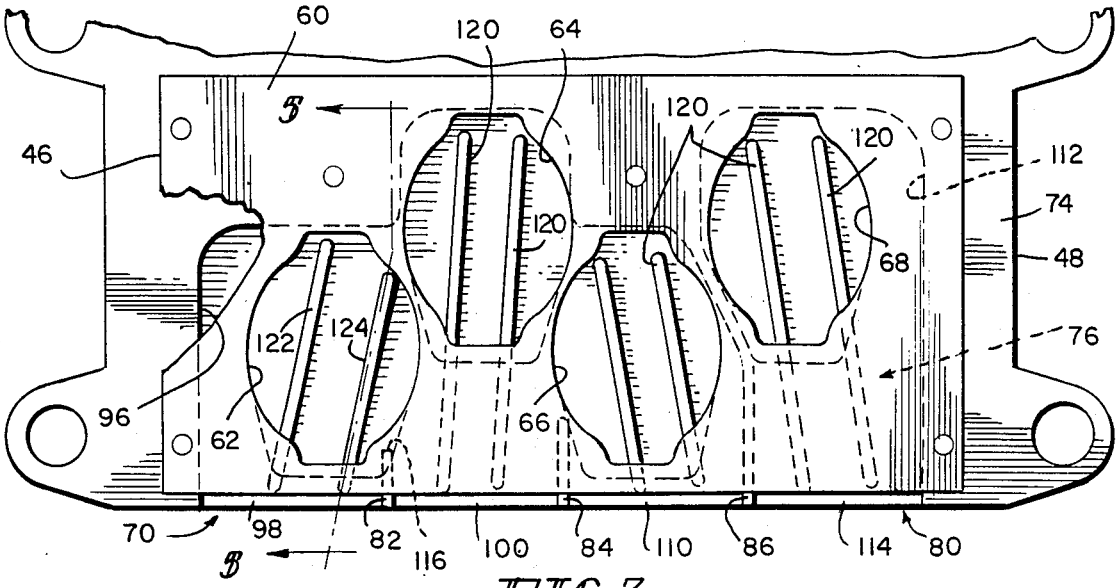
FIG. 3 is a top plan view of the die assembly of FIG. 2 showing one arrangement of the guide rail pairs within each blank transfer lane.

A gravity feed blanking and forming machine 10 embodying the anti-jamming features of the present invention is illustrated diagrammatically in FIG. 1. The blanking and forming machine 10 includes a press section 12 supported in an inclined position by a side frame 14 fixed to skids 16. A feed assembly 18 draws a continuous sheet of blanking material 20 from a conventional roll storage unit 21 having a decurling unit into the press section 12 for processing. The press section 12 includes an upstream blanking station 22 in which the sheet of blanking material 20 is first scored to control the formation of wrinkles in the finished article and then cut to provide a plurality of unformed scored blanks. The press section 12 also includes a downstream blank-forming station 24 in which each of the scored blanks is formed into a plate, tray, or some other similar article. The unformed, scored blanks are fed by gravity from the upstream blanking station 22 to the downstream blank-forming station 24 through a downwardly-sloping chute 26.

The upstream blanking station 22 generates scored blanks 28 from the sheet of blanking material 20 (hereinafter referred to as the "web") and is shown generally in FIG. 1. The upstream blanking station 22 includes a blank punching assembly 30 overlying the web 20 and an associated die assembly 32 underlying the web 20. The blank punching assembly 30 includes a reciprocating platen 34, gear means 36 mounted on rotatable shafts 38 and coupled to the reciprocating platen 34 via connecting means 40, and a motor 41 for rotating the gear means 36 to reciprocate the reciprocating platen 34 along its punching stroke in the conventional way. The reciprocating platen 34 includes a blank-scoring portion 42 at its upstream end and a blank-cutting portion 44 at its downstream end. The lower one-half of the die assembly 32 is shown generally in FIG. 1 and in greater detail in FIGS. 2–5, and includes a cutting die plate 46 and a die shoe 48. The die assembly 32 is configured to provide novel means for consistently releasing blanks 28 from the upstream blanking station 22 after the blanks 28 are cut from the web 20.

The downstream blank-forming station 24 includes a male die 50 overlying the blank 28, a female die 52 underlying the blank 28, a drive cam 54, a cam follower 56, and means (not shown) for coupling the cam follower 56 and the male die 50. The dies 50, 52 operate using known techniques to form a finished article from a scored blank. Reference is hereby made to U.S. Pat. Nos. 4,149,841 and 4,246,223 to Patterson for a description of a suitable forming operation.

The improved system for discharging blanks 28 from the upstream blanking station 22 to the downstream blank-forming station 24 is illustrated in FIGS. 2–5. This system is most advantageously used, for reasons to be given below, in conjunction with a blanking station having a cutting die configured to run the blanks closer together in a "nested" arrangement of the type illustrated generally in FIGS. 2 and 3.

One object of the present invention is to provide means for separating certain adjacent blanks from one another during gravity discharge of the blanks 28 from the upstream blanking assembly 22 into the transfer chute 26. The separating of adjacent blanks aids in preventing jamming of the blanking and forming machine 10 due to entanglement of blanks 28 in the blank-discharging lower one-half of the die assembly 32 of the upstream blanking assembly 22. It is desirable, especially in the case of substantially oval-shaped blanks, to nest the blanks together in the illustrated fashion to reduce the quantity of trim waste generated during blank-cutting operations. While this practice results in a desirable savings of blanking material, it can lead to problems in discharging certain of the nested blanks 28 from the underlying lower one-half of the die assembly 32 due to the close proximity of certain adjacent blanks.

Figure 4:
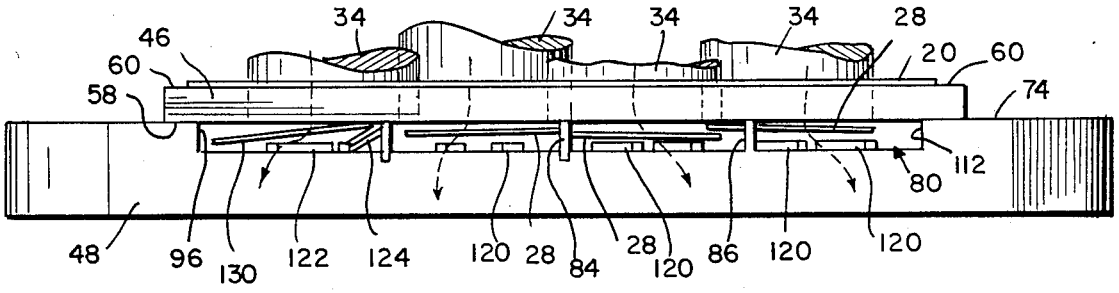
FIG. 4 is a side elevation view of the die assembly of FIG. 2 demonstrating operation of the blanking means to deposit blanks into the underlying blank transfer lanes.

The cutting die plate 46 includes a bottom surface 58 for engaging the underlying die shoe 48 as shown best in FIG. 4. As shown in FIG. 2, the cutting die plate 46 further includes a top surface 60 for slidably supporting the web 20 thereon during blank-cutting operations and a plurality of blank discharge apertures 62, 64, 66, and 68 extending through the cutting die plate 46 between the bottom and top surfaces 58, 60.

The blank discharge aperture 62, 64, 66, and 68 are of substantially oval shape and are nested in closely packed relation to one another as shown best in FIGS. 2 and 3. In particular, the blank discharge apertures 62 and 66 are arranged in a forward line or series extending across the width of a downstream portion 70 of the cutting die plate 46 and blank discharge apertures 64 and 68 are arranged in a rearward line or series extending across the width of an overlapping upstream portion 72 of the cutting die plate 46. As seen in FIGS. 2 and 3, the blank discharge apertures 62, 66 in the forward line are in alternate staggered, nested relation with the blank discharge apertures 64, 68 in the rearward line. It will be understood that it is within the scope of the present invention to provide more than two blank discharge apertures in each of the forward and rearward lines of apertures and also provide an odd number of apertures in the forward line while providing an even number of apertures in the rearward line (and vice versa).

The die shoe 48 includes a top surface 74 for supporting the bottom surface 58 of the cutting die plate 46. A cavity 76 in the die shoe 48 has a top opening in top surface 74 to provide a blank delivery region for receiving blanks 28 discharged through apertures 62, 64, 66, and 68 and conducting those blanks 28 toward the transfer chute 26. The cavity 76 also has a side opening 78 positioned at a downstream edge 80 of the die shoe 48 in communication with transfer chute 26 to permit blanks 28 falling under gravity to be discharged from the die shoe 48 into the transfer chute 26.

A plurality of partitions 82, 84, and 86 are positioned in spaced-apart relation within cavity 76 to divide the blank delivery region into four blank transfer lanes 88, 90, 92, and 94 as best seen in FIGS. 2–4. The first partition 82 is of short length and extends from the downstream edge 80 of the die shoe 48 a short distance into the cavity 76. The first blank transfer lane 88 is situated between a left side wall 96 of the cavity 76 and the first partition 82 and extends from the first blank discharge aperture 62 to a first exit region 98 located at the downstream edge 80. The second partition 84 is slightly longer than the first partition 82 and extends from the downstream edge 80 of the die shoe 48 a relatively longer distance into the cavity 76. The second blank transfer lane 90 is situated between the spaced-apart first and second partitions 82, 84 and extends from the second blank discharge aperture 64 to a second exit region 100 located at the downstream edge 80. The third partition 86 extends from the downstream edge 80 of the die shoe 48 along a slightly "bent" path to join a rearward portion of the die shoe 48 as best seen in FIG. 3. The third blank transfer lane 92 is situated between the spaced-apart second and third partitions 84, 86 and extends from the third blank discharge aperture 66 to a third exit region 110 located at the downstream edge 80. The fourth blank transfer lane 94 is situated between the third partition 86 and a right side wall 112 of cavity 76 and extends from the fourth blank discharge aperture 68 to a fourth exit region 114 at the downstream edge 80.

One problem experienced during operation of a die set up to run nested blanks is that the die is frequently jammed in certain lanes due to entanglement of blanks 28 with each other and with certain portions of the die itself. It has been discovered that jamming problems occur in certain lanes due to the nested position of one of the blank discharge apertures relative to adjacent blank discharge apertures. For example, the nested position of aperture 64 relative to apertures 62 and 66 causes jamming problems in lanes 88 and 90. By comparison, these jamming problems have not occurred in lanes 92 and 96 (presumably because aperture 68 in the rearward line is not nested between two apertures in the forward line).

Referring to FIG. 3, it will be seen that one cause of this jamming problem is that blanks 28 traveling through the second blank transfer lane 90 will necessarily pass through a pair of "blank discharge zones" defined by the first and third discharge apertures 62, 66. Each blank discharge zone is located in cavity 76 and extends between the die shoe 48 to a portion of bottom surface 58 of the cutting die plate 46 adjacent its companion blank discharge aperture 62 or 66. This intrusion of blanks 28 falling through the second blank transfer lane 90 into the blank discharge zones of the first and third discharge apertures 62, 66 results from the "nesting" of the second blank discharge aperture 64 between the first and third discharge aperture 62, 66. Such intrusion often causes blanks 28 falling through the first and second blank transfer lanes 88, 90 to become entangled with each other and/or about the inwardly-facing edge 116 of first partition 82. Entanglement of this type can result in jamming one or both of the first and second blank transfer lanes 88, 90.

The first blank transfer lane 88 is configured differently than the other blank transfer lanes 90, 92, and 94 to provide a remedy to the above-described jamming problems. Thus, the first blank transfer lane 88 can be described as the designated "anti-jamming" lane for the illustrated embodiment. The "anti-jamming" feature is accomplished by the provision in the first blank transfer lane 88 of means for tilting the blanks 28 therein during transit relative to the blanks 28 traveling in the second blank transfer lane 90. Steadily widening separation of those adjacent streams of blanks 28 falling toward the separate first and second exit regions 98, 100 is the result of such tilting means.

A pair of flat, spaced-apart parallel guide rails 120 is provided in each of the second, third, and fourth blank transfer lanes 90, 92, and 94 as shown in FIGS. 2–4. Each pair of guide rails extends between the blank discharge zone of its companion discharge aperture and its companion exit region. In addition, each pair of guide rails is oriented in a selected direction to establish a preferred blank transfer path. While the blank transfer path and the second blank transfer lane 90 is substantially perpendicular to the downstream edge 80 of the die shoe 48, it will be appreciated that the blank transfer paths established in each of the third and fourth blank transfer lanes 92 and 94 are angled relative to downstream edge 80 to guide the blanks 28 falling under gravity through the third and fourth blank transfer lanes 92, 94 away from the second and third partitions 84, 86 to avoid entanglement therewith.

A flat guide rail 122 and a bent guide rail 124 cooperate to define ramp means for tilting blanks relative to the substantially co-planar second, third, and fourth blank transfer paths. Both of guide rails 122 and 124 are positioned to extend between the blank discharge zone of the first discharge aperture 62 and the first exit region 98. The flat guide rail 122 is positioned within the first blank transfer lane 88 in alignment with the plurality of guide rails 120 to define a blank transfer plane extending across the width of the blank delivery region in cavity 76.

Figure 5:
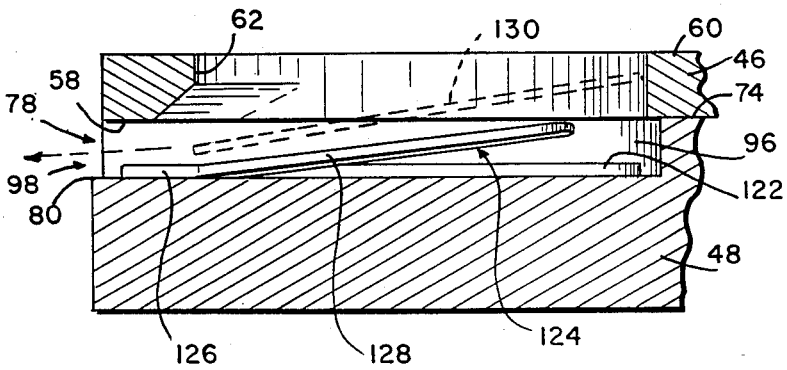
FIG. 5 is an enlarged side elevation view taken along lines 5—5 of FIG. 3 showing the relative alignment of companion first and second guide rails in an anti-jamming lane to provide ramp means for moving blanks in a lateral direction therein.

Referring particularly to FIGS. 3 and 4, the flat guide rail 122 is positioned on the left side of the first blank transfer lane 88 and the bent guide rail 124 is positioned on the right side of the first blank transfer lane 88. Desirably, the bent guide rail 124 is made of a resilient spring material to deflect slightly when contacted by a blank 28 deposited into the first blank transfer lane 88. The bent guide rail 124 includes a substantially flat downstream portion 126 positioned in proximity to the exit region 98 of the first blank transfer lane 88 and aligned in substantially co-planar relation to the companion flat guide rail 122. The bent guide rail 124 further includes an upstream portion 128 that is situated in the blank discharge zone of the first discharge aperture 62 and is canted at a compound angle in relation to the flat guide rail 122 as best seen in FIGS. 4 and 5. As seen in the drawings, the canted upstream portion 128 is inclined to slope downwardly within the first blank transfer lane 88 in a direction away from the second blank transfer lane 90 toward the first exit region 98 and away from the first partition member 82.

In operation, a pre-scored sheet of blanking material 20 is moved along the top surface 60 of the cutting die plate 46 to a blanking position illustrated in FIG. 2. Reciprocating platen 34 generates scored blanks 28 as shown in FIG. 4 by engaging and pushing the pre-scored portion of web 20 through each of the four blank discharge apertures 62, 64, 66, and 68. In this way, the blanks 28 are separated from web 20 and deposited into the underlying blank transfer lanes 88, 90, 92, and 94. All the blanks 28 falling under gravity in the second, third, and fourth blank transfer lanes are guided by the guide rails 120 along the blank transfer plane, the blanks 28 falling into gravity through the "anti-jamming" first blank transfer lane 88 are tilted to move laterally away from the second blank transfer lane 90 to aid in reducing the likelihood that the die assembly 32 will be jammed during discharge of blanks 28 therefrom.

From the foregoing description of the observed jamming problem and its causes, it will be understood that the same problem can occur in blank transfer lanes other than lanes 88 and 90 if the number of blank discharge apertures is increased beyond the four apertures illustrated in the drawings. In general, such jamming problems will occur any time a blank discharge aperture in the rearward line is positioned in nested relation between two blank discharge apertures in the forward line. Thus, in the illustrated embodiment, the position of aperture 64 relative to apertures 62 and 66 causes jamming problems to develop in lanes 88 and 90. For example, if another discharge aperture was added to the forward line to "nest" aperture 68 between the newly added aperture (not shown) and aperture 66, then jamming problems would develop in lane 94 and the newly added lane (not shown). These problems could be overcome by providing ramp means in the newly added lane to tilt blanks falling through the new lane so that those blanks would move laterally away from lane 94 and any partition member (not shown) dividing lane 94 and the newly added lane.

Although the invention has been described in detail with reference to certain preferred embodiments, variations and modifications exist within the scope and spirit of the invention as described and defined in the following claims.

What is claimed is:

1. A press die system for producing blanks from a sheet of material, the press die system comprising a die shoe having an inclined blank delivery region, partition means for dividing the inclined blank delivery region into a plurality of blank-receiving die lanes having entry regions and individual exit regions, the partition means separating at least one of the blank-receiving die lanes and an adjacent blank-receiving die lane including a first end in close proximity to the exit region of the at least one of the blank-receiving die lanes and a second end positioned in spaced relation to the entrance region of the at least one of the blank-receiving die lanes to provide an open region joining the at least one of the blank-receiving die lanes and the adjacent blank-receiving die lane away from the open region, blanking means for piercing the sheet of material in a predetermined pattern to provide a plurality of blanks in alignment with the entry region of the blank-receiving lanes so that each blank falls under gravity into one of the blank-receiving die lanes, and ramp means for guiding blanks generated by the blanking means as the blanks move under gravity through the at least one of the blank-receiving die lanes in a lateral direction away from the adjacent blank-receiving die lane to aid in preventing entanglement in said open region of blanks in said one of the blank-receiving die lanes with blanks in said adjacent blank-receiving die lane.

2. The press die system of claim 1, wherein the ramp means is configured to guide blanks moving through said at least one of the blank-receiving die lanes away from a portion of the partition means intermediate said at least one of the blank-receiving die lanes and said adjacent blank-receiving die lane.

3. A press die system for producing blanks from a sheet of material, the press die system comprising a die shoe having an inclined blank delivery region, partition means for dividing the inclined blank delivery region into a plurality of blank-receiving die lanes having entry regions and individual exit regions, blanking means for piercing the sheet of material in a predetermined pattern to provide a plurality of blanks in alignment with the entry region of the blank-receiving lanes so that each blank falls under gravity into one of the blank-receiving die lanes, ramp means for guiding blanks generated by the blanking means as the blanks move under gravity through at least one of the blank-receiving die lanes in a lateral direction away from an adjacent blank-receiving die lane, the ramp means including a pair of guide rails positioned in the at least one of the blank-receiving die lanes to establish a blank transfer path extending between the entry region and the individual exit region of the at least one of the blank-receiving die lanes, and the pair of guide rails including a first guide rail and a second guide rail having at least a portion that is canted in relation to the first guide rail to intercept blanks deposited into the at least one of the blank-receiving die lanes by the blanking means and to guide said blanks in said lateral direction.

4. The press die system of claim 3, wherein the at least a portion of the second guide rail is made of a resilient material to yieldably urge blanks moving under gravity through the at least one of the blank-receiving die lanes in said lateral direction along said blank transfer path toward the individual exit region.

5. A press die system for producing blanks from a sheet of material, the press die system comprising an inclined die shoe having a blank delivery region, partition means for dividing the blank delivery region into a plurality of individual exit regions, blanking means for piercing the sheet of material in a predetermined pattern to provide a plurality of blanks arranged to fall under gravity into the blank delivery region and toward the individual exit regions, guide means for guiding each of the plurality of blanks generated by the blanking means along a separate blank transfer path toward a companion exit region, the guide means being configured to define a blank transfer plane extending across the blank delivery region, and ramp means for tilting blanks guided along at least one of the blank transfer paths relative to the blank transfer plane to move said blanks laterally in relation to blanks guided in an adjacent blank transfer path to aid in preventing entanglement of blanks in said at least one of the blank transfer paths with blanks in said adjacent blank transfer path and with the partition means.

6. The press die system of claim 5, wherein said at least one blank transfer path includes a first guide rail and a second guide rail having a ramped portion inclined at a compound angle in relation to the first guide rail.

7. The press die system of claim 5, wherein the guide means includes a plurality of first guide rails aligned to define the blank transfer plane and the ramp means includes at least one second guide rail having at least a portion that is positioned at about a predetermined angle relative to the blank transfer plane.

8. The press die system of claim 7, wherein each second guide rail is positioned in close proximity with a companion first guide rail to establish a blank transfer path, the second guide rail including a first portion aligned in substantially coplanar relation to the companion first guide rail and a second portion aligned at a compound angle in relation to the companion first guide rail.

9. The press die system of claim 8, wherein the second portion is inclined to slope downwardly away from said adjacent blank transfer path toward the exit region of said at least one of the blank transfer paths.

10. The press die system of claim 8, wherein at least the second portion of the second guide rail is made of a resilient material to yieldably urge blanks falling under gravity toward the individual exit region of said at least one of the blank transfer paths in said lateral direction.

11. The press die system of claim 8, wherein the first portion of the second guide rail is positioned in close proximity to the exit region of said at least one of the blank transfer paths to present the second portion of the second guide rail toward the opposite end of said at least one of the blank transfer paths.

12. A die assembly for producing blanks from a sheet of material, the die assembly comprising a cutting die plate having a surface for supporting the sheet of material, the cutting die plate being formed to include a plurality of blank discharge apertures arranged in a predetermined pattern, a die shoe formed to include a plurality of blank transfer lanes, each blank transfer lane having an entrance region, an exit region, and a transfer path extending therebetween, at least one pair of adjacent blank transfer lanes being aligned in overlapping relation along their transfer paths, the die shoe being situated underneath the cutting die plate to position each blank transfer lane in alignment with only one of the plurality of blank discharge apertures and inclined to cause blanks situated in the blank transfer lanes to fall under gravity along the transfer paths toward the exit regions, blanking means for piercing the sheet of material to provide a blank aligned with each blank discharge aperture and shaped to fall through its companion blank discharge aperture into the underlying blank transfer lane, an exit partition situated intermediate each pair of adjacent blank transfer lane exit regions to aid in preventing movement of a blank from one blank transfer lane to an adjacent blank transfer lane, and ramp means situated in a first lane of said at least one pair of adjacent blank transfer lanes for guiding a first blank traveling in said first lane away from both of the second lane of said at least one pair of adjacent blank transfer lanes and the exit partition intermediate said first and second lanes in a direction toward its respective exit region to move the first blank laterally with respect to its transfer path in separating relation to a second blank traveling in said second lane substantially to avoid entanglement of the first and second blanks about the exit partition as the first and second blanks move toward their respective exit regions.

13. A die assembly for producing blanks from a sheet of material, the die assembly comprising a cutting die plate having a surface for supporting the sheet of material, the cutting die plate being formed to include a plurality of blank discharge apertures arranged in a predetermined pattern, a die shoe formed to include a plurality of blank transfer lanes, each blank transfer lane having an entrance region, an exit region, and a transfer path extending therebetween, the die shoe being situated underneath the cutting die plate to position each blank transfer lane in alignment with only one of the plurality of blank discharge apertures and inclined to cause blanks situated in the blank transfer lanes to fall under gravity along the transfer paths toward the exit regions, blanking means for piercing the sheet of material to provide a blank aligned with each blank discharge aperture and shaped to fall through its companion blank discharge aperture into the underlying blank transfer lane, a partition situated intermediate each pair of adjacent blank transfer lanes to aid in preventing movement of a blank from one blank transfer lane to an adjacent blank transfer lane, and ramp means for guiding a first blank traveling in the at least one of the blank transfer lanes away from both an adjacent blank transfer lane and a partition intermediate the at least one of the blank transfer lanes and the adjacent blank transfer lane in a direction toward its respective exit region to move the first blank laterally with respect to its transfer path in separating relation to a second blank traveling in the adjacent blank transfer lane substantially to avoid entanglement of the first and second blanks about the partition as the first and second blanks move toward their respective exit regions, the partition separating the at least one of the blank transfer lanes and the adjacent blank transfer lane including a first end in close proximity to the exit region of the at least one of the blank transfer lanes and a second end positioned in spaced relation to the entrance region of the at least one of the blank transfer lanes to provide an open region joining the at least one of the blank transfer lanes and the adjacent blank transfer lane, and the ramp means being oriented to guide blanks traveling in the at least one of the blank transfer lanes away from the open region.

14. A die assembly for producing blanks from a sheet of material, the die assembly comprising a cutting die plate having a surface for supporting the sheet of material, the cutting die plate being formed to include a plurality of blank discharge apertures arranged in a predetermined pattern, a die shoe formed to include a plurality of blank transfer lanes, each blank transfer lane having an entrance region, an exit region, and a transfer path extending therebetween, the die shoe being situated underneath the cutting die plate to position each blank transfer lane in alignment with only one of the plurality of blank discharge apertures and inclined to cause blanks situated in the blank transfer lanes to fall under gravity along the transfer paths toward the exit regions, blanking means for piercing the sheet of material to provide a blank aligned with each blank discharge aperture and shaped to fall through its companion blank discharge aperture into the underlying blank transfer lane, a partition situated intermediate each pair of adjacent blank transfer lanes to aid in preventing movement of a blank form one blank transfer lane to an adjacent blank transfer lane, and ramp means for guiding a first blank traveling in the at least one of the blank transfer lanes away from both an adjacent blank transfer lane and a partition intermediate the at least one of the blank transfer lanes and the adjacent blank transfer lane in a direction toward its respective exit region to move the first blank laterally with respect to its transfer path in separating relation to a second blank traveling in the adjacent blank transfer lane substantially to avoid entanglement of the first and second blanks about the partition as the first and secopd blanks move toward their respective exit regions, said at least one blank transfer lane including a first guide rail and a second guide rail having a ramped portion inclined at a compound angle in relation to the first guide rail.

15. A die assembly for producing blanks from a sheet of material, the die assembly comprising a cutting die plate having a surface for supporting the sheet of material, the cutting die plate being formed to include a plurality of blank discharge apertures arranged in a predetermined pattern, a die shoe formed to include a plurality of blank transfer lanes, each blank transfer lane having an entrance region, an exit region, and a transfer path extending therebetween, the die shoe being situated underneath the cutting die plate to position each blank transfer lane in alignment with only one of the plurality of blank discharge apertures and inclined to cause blanks situated in the blank transfer lanes to fall under gravity along the transfer paths toward the exit regions, blanking means for piercing the sheet of material to provide a blank aligned with each blank discharge aperture and shaped to fall through its companion blank discharge aperture into the underlying blank transfer lane, a partition situated intermediate each pair of adjacent blank transfer lanes to aid in preventing movement of a blank from one blank transfer lane to an adjacent blank transfer lane, and ramp means for guiding a first blank traveling in the at least one of the blank transfer lanes away from both an adjacent blank transfer lane and a partition intermediate the at least one of the blank transfer lanes and the adjacent blank transfer lane in a direction toward its respective exit region to move the first blank laterally with respect to its transfer path in separating relation to a second blank traveling in the adjacent blank transfer lane substantially to avoid entanglement of the first and second blanks about the partition as the first and second blanks move toward their respective exit regions, the ramp means including a pair of guide rails positioned in the at least one of the blank transfer lanes, the pair of guide rails including a first guide rail and a second guide rail having at least a portion that is canted in relation to the first guide rail to intercept blanks deposited into the at least one of the blank transfer lanes by the blanking means and to guide said blanks in said separating direction.

16. The die assembly of claim 15, wherein the at least a portion of the second guide rail is made of a resilient material to yieldably urge blanks traveling in said at least one of the blank transfer lanes in separating relation to blanks traveling in said adjacent blank transfer lane.

17. The press die system of claim 12, wherein the ramp means includes a plurality of first guide rails aligned to define a blank transfer plane and at least one second guide rail having at least a portion that is positioned at about a predetermined angle relative to the blank transfer plane.

18. The press die system of claim 17, wherein each second guide rail is positioned in close proximity with a companion first guide rail to establish a blank transfer path, the second guide rail including a first portion aligned in substantially coplanar relation to the companion first guide rail and a second portion aligned at a compound angle in relation to the companion first guide rail.

19. A die assembly for producing blanks from a sheet of material, the die assembly comprising a die shoe including a surface having a discharge edge, a cutting die plate having a support surface for supporting the sheet of material, the cutting die plate being formed to include a first and a second series of blank discharge apertures, the first series including first and second blank discharge apertures positioned in spaced-apart relation, the second series including a first blank discharge aperture positioned intermediate the first and second blank discharge apertures of the first series in nested relation;

blanking means for piercing the sheet of material to provide a blank in each blank discharge aperture, means for supporting the cutting die plate above the surface of the die shoe in spaced-apart relation to position the first series of blank discharge apertures in close proximity to the discharge edge of the die shoe surface, each blank discharge aperture defining a companion interior blank discharge zone extending between the support surface of the cutting die plate and the surface of the die shoe, partition means for defining a plurality of exit regions at the discharge edge of the die shoe surface extending between the die shoe and the cutting die plate, each exit region being aligned with a single blank discharge zone to establish a blank transfer path therebetween, the die shoe being inclined to cause each blank deposited onto its blank transfer path via its companion blank transfer zone to fall under gravity along its blank transfer path toward its companion exit region, blanks traveling along the blank transfer path in communication with the blank discharge zone defined by the first blank discharge aperture of the second series intercepting and passing through a portion of the blank discharge zone defined by the first blank discharge aperture of the first series due to the nested arrangement of said adjacent first apertures, and ramp means extending into the blank discharge zone defined by the first blank discharge aperture of the first series to guide blanks moving therein laterally away from the blank transfer path in communication with the blank transfer zone defined by the first blank discharge aperture of the second series to avoid entanglement of blanks traveling on adjacent blank transfer paths in communication with the first blank discharge apertures of the first and second series.

20. The die assembly of claim 19, wherein the ramp means is configured to guide blanks traveling along said blank transfer path away from a portion of the partition means intermediate said adjacent blank transfer paths.

21. The die assembly of claim 20, wherein the ramp means includes a first guide rail and a second guide rail having a ramp portion inclined at a compound angle in relation to the first guide rail.

22. The die assembly of claim 21, wherein the ramped portion is positioned within the blank discharge zone defined by the first blank discharge aperture of the first series to slope downwardly away from the first blank discharge aperture of the second series toward the discharge edge.

* * * * *